US005682714A

United States Patent [19]

Ishikuro et al.

[11] Patent Number: 5,682,714

[45] Date of Patent: Nov. 4, 1997

[54] PARTITIONING SASH

[75] Inventors: Yoshinori Ishikuro; Masao Hirano, both of Toyama-ken; Hiroshi Miyazaki, Tokyo, all of Japan

[73] Assignee: YKK Architectural Products Inc., Tokyo, Japan

[21] Appl. No.: 527,867

[22] Filed: Sep. 13, 1995

[30] Foreign Application Priority Data

Oct. 28, 1994 [JP] Japan ..... 6-264992
Oct. 28, 1994 [JP] Japan ..... 6-265030

[51] Int. Cl.[6] ..... F06B 3/00

[52] U.S. Cl. ..... 52/204.5; 52/204.59; 52/235; 52/275; 52/204.51

[58] Field of Search ..... 52/204.5, 204.57, 52/204.591, 205.51, 205.63, 235, 275

[56] References Cited

U.S. PATENT DOCUMENTS

| | | | |
|---|---|---|---|
| 3,176,806 | 4/1965 | Ferrell | 52/204.591 X |
| 3,352,078 | 11/1967 | Beal | 52/204.591 X |
| 3,798,862 | 3/1974 | Stoakes | 52/204.591 |
| 4,598,513 | 7/1986 | Gartner | 52/235 X |

FOREIGN PATENT DOCUMENTS

| | | | |
|---|---|---|---|
| 0148812 | 7/1985 | European Pat. Off. | 52/204.51 |
| 55-129970 | 9/1980 | Japan . | |
| 6288150 | 11/1994 | Japan | 52/204.5 |

*Primary Examiner*—Carl D. Friedman
*Assistant Examiner*—Winnie Yip
*Attorney, Agent, or Firm*—Finnegan, Henderson, Farabow, Garrett & Dunner, L.L.P.

[57] ABSTRACT

A partitioning sash comprises at least one multi window mullion for forming a multiple window portion, at least one salient corner mullion for forming a salient angle portion and at least one reentrant corner mullion for forming a reentrant angle portion. The multi window mullion, the salient corner mullion, and the reentrant corner mullion has the same dimension measured in a direction parallel to a width of the sash. Each of the salient corner mullion and the reentrant corner mullion is constituted of a mullion body and an auxiliary frame body. The mullion body has a glass receptacle groove on a side surface to be located at one side in a direction parallel to the width of the sash, end has recesses on side surfaces to be located at both sides in a direction parallel to the depth of the sash. The auxiliary frame body has a mounting surface to be located at one side in a direction parallel to the depth of the sash, and has a glass receptacle groove formed on a side surface opposite to the mounting surface so as to open in a direction parallel to the depth of the sash. The mounting surface is provided with a pair of engaging pieces. The mullion body and the auxiliary frame body are coupled with each other by selectively engaging the engaging pieces in either one of the recesses so as to form either the salient corner mullion or the reentrant corner mullion.

16 Claims, 4 Drawing Sheets

PARTITIONING SASH

BACKGROUND OF THE INVENTION

1. Field of the Invention

The present invention relates generally to a partitioning sash comprising a salient angle portion and a reentrant angle portion and having a flat external appearance, used for forming an entrance system or so forth. The invention also relates to a mullion usable for forming a salient angle portion, a reentrant angle portion, a T-shaped portion or so forth of the sash.

2. Description of the Prior Art

As a partitioning sash for forming an entrance system or so forth, there is known a sash comprising a multiple window portion, a salient angle portion and a reentrant angle portion and having a flat external appearance. Upper and lower horizontal members are fitted between a mullion for forming the multiple window portion (hereinafter referred to as "a multi window mullion") and a mullion for forming the salient angle portion (hereinafter referred to as "a salient corner mullion"), between a salient corner mullion and a mullion for forming the reentrant angle portion (hereinafter referred to as "a reentrant corner mullion"), and between a reentrant corner mullion and a multi window mullion, respectively, thereby forming a sash frame having a plurality of quadrangular frame portions. Glasses are installed in the respective quadrangular frame portions.

As mullions for forming the sash, there are known such multi window mullion as having each one glass receptacle groove at both sides in a direction parallel to a width of the sash (hereinafter referred to as "a width direction of the sash") for supporting two glasses along the width direction of the sash, such corner mullion for forming a salient or reentrant angle portion as having each one glass receptacle groove at one side in the width direction of the sash and at one side in a direction parallel to a depth of the sash (hereinafter referred to as "a depth direction") for supporting two glasses along the width direction of the sash and along the depth direction of the sash, and such T-junction mullion for forming a T-shaped portion as having each one glass receptacle groove at both sides in the width direction of the sash and at one side in the depth direction of the sash for supporting three glasses in T-shaped arrangement.

As shown in Japanese Unexamined Utility Model Publication (Kokai) No. Sho 55-129970, since the multi window mullion supports glasses only along the width direction of the sash, the multi window mullion is so formed as having a smaller dimension measured in the width direction of the sash (hereinafter referred to as "a width dimension") than a dimension measured in the depth direction of the sash (hereinafter referred to as "a depth dimension"). In contrast thereto, since the salient or reentrant corner mullion supports glasses both along the width direction of the sash and along the depth direction of the sash, the salient or reentrant corner mullion is so formed as having a width dimension equal to a depth dimension.

As a result, when the sash is viewed from the front side, there are seen the multi window mullions having a smaller width dimension and the salient and/or reentrant corner mullions having a larger width dimension. Therefore, the salient and/or reentrant angle portions are distinctly discriminated from the rest portion of the sash, which harms the external appearance of the sash. Furthermore, due to the large width dimension of the salient and reentrant corner mullions, a difference between the inside width dimension and the outside width dimension of the sash is forced to be relatively large, or in other words, a ratio of an inside area to a setting area of the sash is forced to be relatively small.

The foregoing Japanese Unexamined Utility Model Publication No. Sho 55-129970 also discloses such corner mullion as comprising a mullion body having each one glass receptacle groove at both sides in the width direction of the sash and at one side in the depth direction of the sash, and an attachment to be detachably fitted to the glass receptacle groove. The mullion can be used as either a salient corner mullion or a reentrant corner mullion by selectively fitting the attachment to one of the glass receptacle grooves provided at both sides in the width direction of the sash, and also can be used as a T-junction mullion by removing the attachment.

Out of the necessity of providing glass receptacle grooves at both sides in the width direction of the sash and at one side in the depth direction of the sash, the shown mullion is so formed as having a width dimension equal to a depth dimension. As a result, the mullion has a relatively large cross section.

Further, since the shown mullion is constituted of three parts, the assembling works are cumbersome.

Furthermore, a position of the glass receptacle groove which is provided at one side in the depth direction of the sash for supporting a glass along the depth direction of the sash is fixed in the width direction of the sash. Therefore, the glass to be installed along the depth direction of the sash is mounted to the corner mullion at the same fixed position in the width direction of the sash, whichever side in the width direction of the sash the corner mullion is used at (or in other words, whichever side in the width direction of the sash the salient and reentrant angle portions are formed at). This restricts the possibility of securing a large internal space when the sash is used for dividing an internal space from an external space.

For example, supposing that the salient and reentrant angle portions are formed at a right side in the width direction of the sash, a relatively large internal space can be defined when the glass to be installed along the depth direction of the sash is mounted on the salient and reentrant corner mullions respectively at a position biased to the right side in the width direction of the sash. On the contrary, supposing that the salient and reentrant angle portions are formed at a left side in the width direction of the sash, a relatively large internal space can be defined when the glass to be installed along the depth direction of the sash is mounted on the salient and reentrant corner mullions relatively at a position biased to the left side in the width direction of the sash. However, in case of the above-mentioned corner mullion, since the position of the glass receptacle groove for the glass to be installed along the depth direction of the sash is fixed in the width direction of the sash, it is not possible to define a large internal space irrespective of which side the salient and reentrant angle portions are to be formed at.

SUMMARY OF THE INVENTION

The object of the present invention is to eliminate defects or drawbacks encountered in the prior art described above.

More specifically, an object of the present invention is to provide a partitioning sash having an excellent external appearance in which a salient angle portion and a reentrant angle portion are hard to be recognized.

Another object of the present invention is to provide a partitioning sash which can secure a larger internal space when it is used for dividing an internal space from an external space.

Another object of the present invention is to provide a mullion being usable for forming a salient or reentrant angle portion of the sash, and having a smaller width dimension.

Another object of the present invention is to provide a mullion being usable for forming a salient or reentrant angle portion of the sash, and not requiring cumbersome assembling works.

According to one aspect of the present invention, there is provided a partitioning sash comprising:

at least one multi window mullion for forming a multiple window portion of the sash, having glass receptacle grooves on side surfaces situated at both sides in a first direction parallel to a width of the sash;

at least one salient corner mullion for forming a salient angle portion of the sash, having a first glass receptacle groove on a side surface situated at a first side in the first direction and a second glass receptacle groove on a side surface situated at a first side in a second direction parallel to a depth of the sash, a dimension of the salient corner mullion measured in the first direction being equal to a dimension of the multi window mullion measured in the first direction;

at least one reentrant salient corner mullion for forming a reentrant angle portion of the sash, having a first glass receptacle groove on a side surface situated at a second side opposite to the first side in the first direction and a second glass receptacle groove on a side surface situated at a second side opposite to the first side in the second direction, a dimension of the reentrant corner mullion measured in the first direction being equal to the dimension of the multi window mullion measured in the first direction;

upper and lower horizontal members fitted between each two adjacent mullions of the multi window, salient corner and reentrant corner mullions, thereby forming a sash frame having a plurality of quadrangular frame portions; and glasses installed in the quadrangular frame portions.

According to this aspect of the present invention, since the width dimension of the salient corner mullion and the width dimension of the reentrant corner mullion are respectively equal to the width dimension of the multi window mullion, the salient angle portion and the reentrant angle portion are hard to be recognized when the sash is viewed from the front side, and it appears as if the sash were made only of the multiple window portion. This contributes to an excellent external appearance of the sash.

In a preferred embodiment, the salient corner mullion comprises a mullion body having the first glass receptacle groove on a side surface situated at the first side in the first direction and an auxiliary frame body having the second glass receptacle groove on a side surface situated at the first side in the second direction, the mullion body and the auxiliary frame body being coupled with each other in such manner that a side surface of the auxiliary frame body situated at the second side in the second direction is fixed to a side surface of the mullion body situated at the first side in the second direction, and wherein the reentrant corner mullion comprises a mullion body having the first glass receptacle groove on a side surface situated at the second side in the first direction and an auxiliary frame body having the second glass receptacle groove on a side surface situated at the second side in the second direction, the mullion body and the auxiliary frame body being coupled with each other in such manner that a side surface of the auxiliary frame body situated at the first side in the second direction is fixed to a side surface of the mullion body situated at the second side in the second direction.

With this construction, the width dimension of the salient and reentrant corner mullions can be made smaller, so that a ratio of an inside area to a setting area of the sash can be made larger.

Preferably, the second glass receptacle groove of the salient corner mullion and the second glass receptacle groove of the reentrant corner mullion are respectively provided at a position biased to the second side in the first direction. With this arrangement of the second glass receptacle groove of the salient corner mullion and the second glass receptacle groove of the reentrant corner mullion, a larger internal space can be secured in case the sash is used for dividing an internal space from an external space.

According to another aspect of the present invention, there is provided a mullion for forming a sash, comprising:

a mullion body having a first glass receptacle groove on a side surface to be located at a first side in a first direction parallel to a width of the sash, and having first and second recesses on side surfaces to be located at both sides in a second direction parallel to a depth of the sash, the first and second recesses having the same opening width; and an auxiliary frame body having a mounting surface to be located at one side in the second direction, and having a second glass receptacle groove formed on a side surface opposite to the mounting surface so as to open in the second direction, the mounting surface being provided with a pair of engaging pieces projecting in the second direction for being engaged in one of the first and second recesses.

According to this aspect of the present invention, either a salient corner mullion or a reentrant corner mullion can be selectively constructed depending upon coupling manner of the mullion body and the auxiliary frame body, and that with a smaller cross section. Further, due to the provision of the engaging pieces and the first and second recesses, the auxiliary frame body is fixed onto the mullion body after having the engaging pieces engaged in one of the first and second recesses. This facilitates the assembling works for the mullion. Furthermore, the position in the first direction of the second glass receptacle groove of the mullion can be changed by adopting another auxiliary frame body having a glass receptacle groove at a different position in the first direction, or, in case the auxiliary frame body has a glass receptacle groove at a position biased to one side in the first direction, by reversedly fitting the auxiliary frame body to the mullion body. This provides a possibility of securing a larger internal space when a sash to be formed is used for dividing an internal space from an external space.

According to another aspect of the present invention, there is provided a mullion for forming a sash, comprising:

a mullion body having first and second glass receptacle grooves on side surfaces to be located at both sides in a first direction parallel to a width of the sash, and having first and second recesses on side surfaces to be located at both sides in a second direction parallel to a depth of the sash, the first and second recesses having the same opening width;

an auxiliary frame body having a mounting surface to be located at one side in the second direction, and having a third glass receptacle groove formed on a side surface opposite to the mounting surface so as to open in the second direction, the mounting surface being provided with a pair of engaging pieces projecting in the second direction for being engaged in one of the first and second recesses; and an attachment capable of being detachably fitted to one of the first and second glass receptacle grooves.

According to this aspect of the present invention, the mullion body can be by itself used as a multi window mullion. When the mullion body and the auxiliary frame body are coupled with each other to form a mullion, thus formed mullion can be used as either a salient corner mullion or a reentrant corner mullion by selectively fitting the attachment to one of the first and second glass receptacle grooves. When the attachment is not fitted, the mullion can be used as a T-junction mullion.

BRIEF DESCRIPTION OF THE DRAWINGS

The present invention will be understood more fully from the detailed description given herebelow and from the accompanying drawings of preferred embodiments of the invention, which, however, should not be taken to be limitative to the present invention, but are for explanation and understanding only.

In the drawings.

DESCRIPTION OF THE PREFERRED EMBODIMENT

The present invention will be described hereinafter in detail with reference to the accompanying drawings. In the following description, numerous specific details are set forth in order to provide a thorough understanding of the present invention. It will be obvious, however, to those skilled in the art that the present invention may be practiced without these specific details. On the other hand, well-known structures are not shown in detail in order to unnecessarily obscure the present invention.

Figure 1:
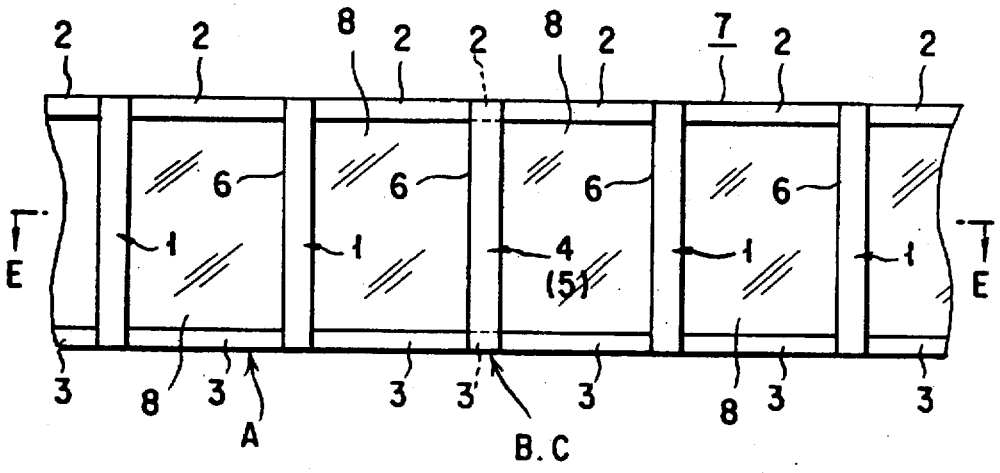
FIG. 1 is a front elevation of an embodiment of a partitioning sash according to the present invention.
Figure 2:
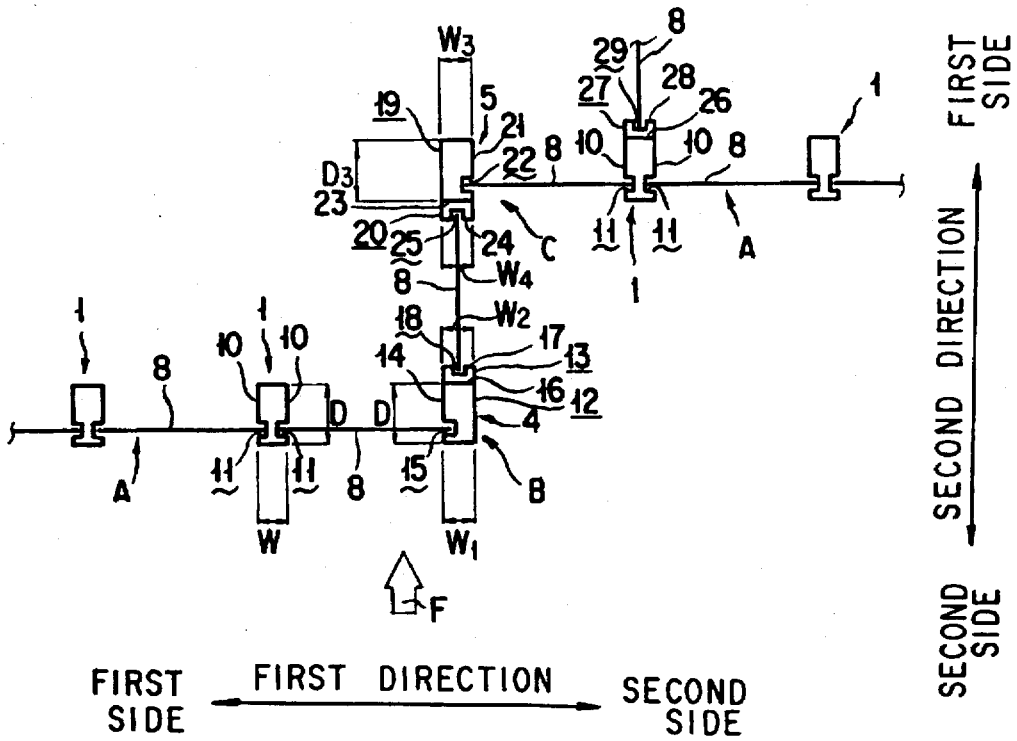
FIG. 2 is a section taken along line E—E of FIG. 1.

As shown in FIGS. 1 and 2, an upper horizontal member 2 and a lower horizontal member 3 are fitted between each two adjacent ones of a plurality of multi window mullions 1 so as to extend in a first direction parallel to a width of a sash (a lateral direction according to the illustration of FIG. 2), an upper horizontal member 2 and a lower horizontal member 3 are fitted between a multi window mullion 1 nearest to an end of a multiple window portion A and a salient corner mullion 4 so as to extend in the first direction, an upper horizontal member 2 and a lower horizontal member 3 are fitted between the salient corner mullion 4 and a reentrant corner mullion 5 so as to extend in a second direction parallel to a depth of the sash (a vertical direction according to the illustration of FIG. 2), and an upper horizontal member 2 and a lower horizontal member 3 are fitted between the reentrant corner mullion 5 and a multi window mullion 1 so as to extend in the first direction, thereby forming a sash frame 7 having a plurality of quadrangular frame portions 6. Glasses 8 are installed in the respective quadrangular frame portions 6. Thus, the partitioning sash comprising a multi window portion A, a salient angle portion B and a reentrant angle portion C is formed.

As shown in FIG. 2, the multi window mullion 1 has a rectangular cross section, and a dimension W of the multi window mullion measured in the first direction is smaller than a dimension D thereof measured in the second direction. On side surfaces 10 of the multi window mullion 1 which are situated at both sides in the first direction (left and right sides according to the illustration of FIG. 2), each one glass receptacle groove 11 opening in the first direction is formed continuously in the longitudinal direction of the multi window mullion 1.

The salient corner mullion 4 is constituted of a mullion body 12 and an auxiliary frame body 13. A dimension $W_1$ of the mullion body 12 measured in the first direction and a dimension $D_1$ thereof measured in the second direction are respectively equal to the dimensions W and D of the multi window mullion 1. On a side surface 14 of the mullion body 12 which is situated at a first side in the first direction (a left side according to the illustration of FIG. 2), a glass receptacle groove 15 opening in the first direction is formed continuously in the longitudinal direction of the mullion body 12. Onto a side surface 16 of the mullion body 12 which is situated at a first side in the second direction (an upper side according to the illustration of FIG. 2), the auxiliary frame body 13 is fixed by means of screws or so forth.

A dimension $W_2$ of the auxiliary frame body 13 measured in the first direction is equal to the dimension $W_1$ of the mullion body 12. On a side surface 17 of the auxiliary frame body 13 which is situated at the first side in the second direction (the upper side according to the illustration of FIG. 2), a glass receptacle groove 18 opening in the second direction is formed continuously in the longitudinal direction of the auxiliary frame body 13.

The reentrant corner mullion 5 is constituted of a mullion body 19 and an auxiliary frame body 20. A dimension $W_3$ of the mullion body 19 measured in the first direction and a dimension $D_3$ thereof measured in the second direction are respectively equal to the dimensions W and D of the multi window mullion 1. On a side surface 21 of the mullion body 19 which is situated at a second side opposite to the first side in the first direction (a right side according to the illustration of FIG. 2), a glass receptacle groove 22 opening in the first direction is formed continuously in the longitudinal direction of the mullion body 19. Onto a side surface 23 of the mullion body 19 which is situated at a second side opposite to the first side in the second direction (a lower side according to the illustration of FIG. 2), the auxiliary frame body 20 is fixed by means of screws or so forth.

A dimension $W_4$ of the auxiliary frame body 20 measured in the first direction is equal to the dimension $W_3$ of the mullion body 19. On a side surface 24 of the auxiliary frame body 20 which is situated at the second side in the second direction (the lower side according to the illustration of FIG. 2), a glass receptacle groove 25 opening in the second direction is formed continuously in the longitudinal direction of the auxiliary frame body 20.

As is clear from the above description, the auxiliary frame bodies 13 and 20 of the salient corner mullion 4 and the reentrant corner mullion 5 have the same cross section.

Onto a side surface 26 of a multi window mullion 1 adjacent to the reentrant corner mullion 5 which is situated at the first side in the second direction (the upper side according to the illustration of FIG. 2), an auxiliary frame body 27 is fixed by means of screws or so forth. On a side surface 28 of the auxiliary frame body 27 which is situated at the first side in the second direction (the upper side according to the illustration of FIG. 2), a glass receptacle groove 29 opening in the second direction is formed continuously in the longitudinal direction of the auxiliary frame body 27. The auxiliary frame body 27 has also the same cross section as that of the auxiliary frame bodies 13 and 20.

Thus, when the sash is viewed from the front side as indicated by an arrow F, the salient corner mullion 4 and the reentrant corner mullion 5 overlap each other so that only the salient corner mullion 4 comes in sight. Further, since the dimension $W_1$ of the salient corner mullion 4 measured in the first direction is equal to the dimension W of the multi window mullions 1 measured in the first direction, the salient angle portion B and the reentrant angle portion C are hard to be recognized and it appears as if the sash were made only of the multiple window portion A.

In the shown embodiment, each of the salient corner mullion 4 and the reentrant corner mullion 5 is constituted of the mullion body 12, 19 and the auxiliary frame body 13, 20 which are formed separately from each other. However, each of the salient corner mullion 4 and the reentrant corner mullion 5 may be formed as one body having an integrated construction of the mullion body 12, 19 and the auxiliary frame body 13, 20.

Figure 3:
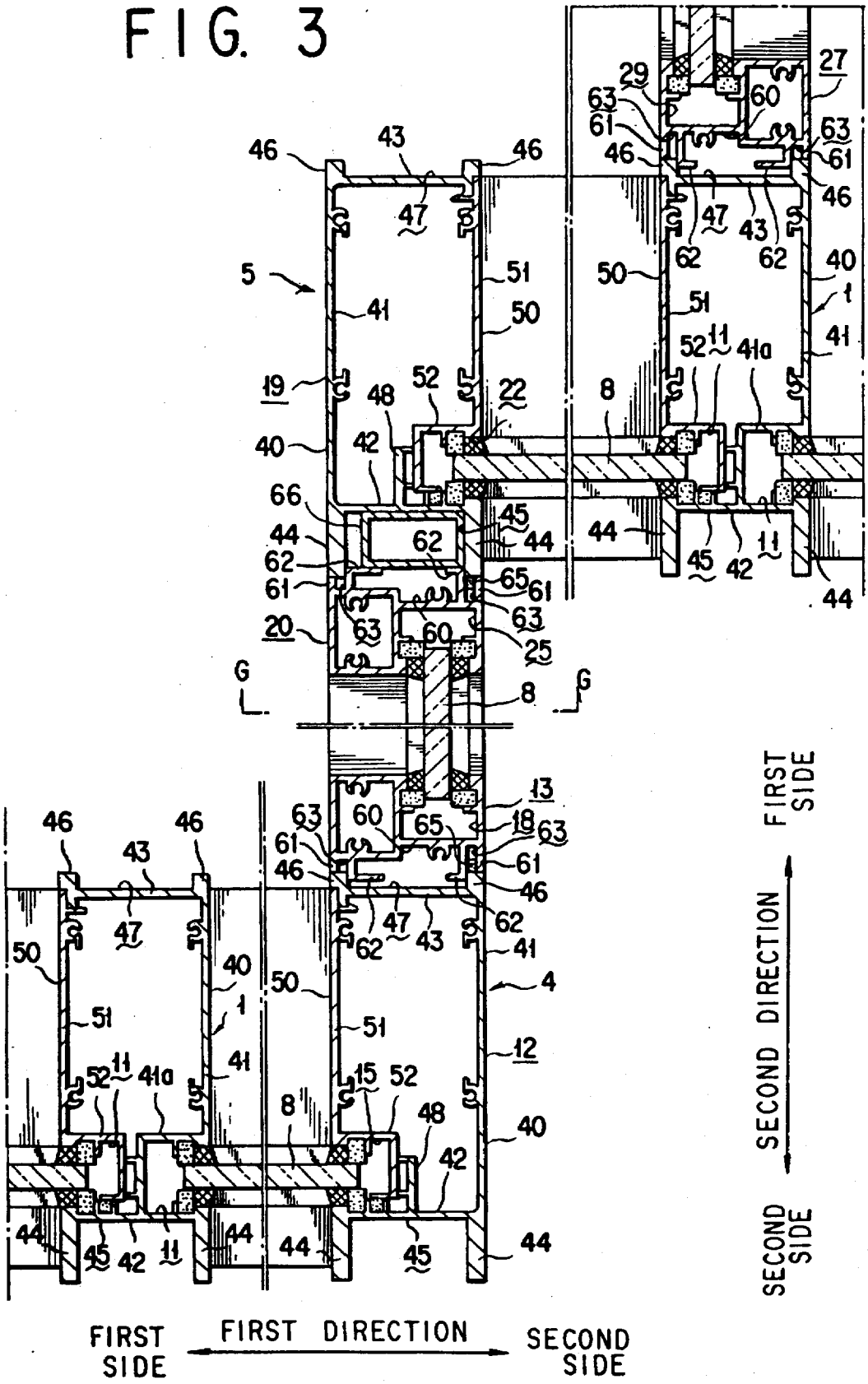
FIG. 3 is a cross section showing detailed construction of a preferred embodiment of the partitioning sash according to the present invention.

FIG. 3 shows more detailed structure of the preferred embodiment of the partitioning sash according to the present invention. As shown therein, each of the multi window mullion 1, the mullion body 12 of the salient corner mullion 4 and the mullion body 19 of the reentrant corner mullion 5 is constructed as a split mullion, in which a first vertical frame 40 and a second vertical frame 50 are connected by means of screws. The first vertical frame 40 comprises a first vertical plate 41 extending in the second direction, a second vertical plate 42 extending in the first direction and a third vertical plate 43 extending in the first direction, which cooperate to form a C-like shape in cross section. The second vertical plate 42 has a pair of projecting plates 44 integrally formed to its end portions situated at both sides in the first direction so as to define a recess 45 opening in the second direction. The third vertical plate 43 has a pair of projections 46 integrally formed to its end portions situated at both sides in the first direction so as to define a recess 47.

An end portion 41*a* of the first vertical plate 41 of the first vertical frame 40 of the multi window mullion 1, which is situated at the second side in the second direction, is bent into hooked configuration so as to define a glass receptacle groove 11 in cooperation with the second vertical plate 42. On the other hand, the first vertical plate 41 of the first vertical frame 40 of each of the mullion body 12 of the salient corner mullion 4 and the mullion body 20 of the reentrant corner mullion 5 has a flat configuration. The second vertical plate 42 thereof has a connecting projection 48 integrally formed to its middle portion in the first direction. A glass receptacle groove is not formed on the first vertical frame 40 of either of the salient corner mullion 4 or the reentrant corner mullion 5.

The second vertical frame 50 is constituted of a vertical plate 51 and a C-like vertical plate 52. The C-like vertical plate 52 is connected to the end portion 41*a* of the first vertical plate 41 (in case of the multi window mullion 1) or to the connecting projection 48 (in case of the salient corner mullion 4 or the reentrant corner mullion 5) by means of screws so as to define the glass receptacle groove 11, 15 or 22. The vertical plate 51 is engaged and connected with the third vertical plate 43.

As can be seen, the mullion body 12 of the salient corner mullion 4 and the mullion body 20 of the reentrant corner mullion 5 are set in mutually reversed arrangement with respect to the first direction. The first vertical frames 40 of the mullion body 12 and the mullion body 20 are located at mutually opposite sides in the first direction and set in mutually reversed arrangement with respect to the first direction. Similarly, the second vertical frames 50 of the mullion body 12 and the mullion body 20 are located at mutually opposite sides in the first direction and set in mutually reversed arrangement with respect to the first direction. Thus, the glass receptacle grooves 15 and 22 open towards mutually opposite sides in the first direction.

A side surface (mounting surface) 60 of the auxiliary frame body 13 or 20 which is situated at one side in the second direction has a pair of supporting pieces 61, 61 integrally formed to its end portions situated at both sides in the first direction, and a pair of engaging pieces 62, 62 in hooked configuration integrally formed in the vicinity of those end positions. A pair of grooves 63 are defined respectively between the supporting piece 61 and the engaging piece 62. The engaging piece 62 has a projecting length larger than that of the supporting piece 61. A distance between a pair of engaging pieces 62 corresponds to an opening width of the recess 47. On a side surface opposite to the mounting surface 60, a glass receptacle groove 18 or 25 is formed at a position biased to one side in the second direction so as to open in the second direction.

The mullion body 12 and the auxiliary frame body 13 of the salient corner mullion 4 are coupled by engaging a pair of engaging pieces 62, 62 in the recess 47 and connecting each other by means of screws. The position in the second direction of auxiliary frame body 13 is regulated by the supporting pieces 61, 61 which come into contact with the projections 46, 46. In the groove 63 situated at the external side (a right side according to the illustration of FIG. 3), a sealing member 65 formed of a foamed rubber such as CR, EPDM and so forth is installed. The sealing member 65 is pressed onto the projection 46, thereby sealing the connecting portions of the mullion body 12 and the auxiliary frame body 13 situated at the external side.

The mullion body 19 and the auxiliary frame body 20 of the reentrant mullion 5 are coupled by engaging the engaging pieces 62, 62 in the recess 45 and connecting the engaging pieces 62, 62 to a reinforcement member 66 by means of screws. The reinforcement member 66 has a hollow rectangular configuration and is fixed to the recess 45.

An opening width of the recess 45 is equal to that of the recess 47, but an opening depth of the recess 45 is larger than that of the recess 47. Therefore, the mullion body 19 and the auxiliary frame body 20 can not be coupled by engaging in the recess 45 the engaging pieces 62, 62 that have the same configurations as those of the engaging pieces 62, 62 to be engaged in the recess 47. Therefore, the reinforcement member 66 is employed.

As is clear from the above description, either the salient corner mullion 4 or the reentrant corner mullion 5 can be selectively constructed depending upon coupling manner of the mullion body 12, 19 and the auxiliary frame body 13, 20. Since the grooves 63 are formed to both end portions of the mounting surface 60 located at both sides in the first direction, it is possible to seal the connecting portions of the mullion body 12 and the auxiliary frame body 13 situated at the external side as well as the connecting portions of the mullion body 19 and the auxiliary frame body 20 situated at the external side, though the auxiliary frame body 19 and the auxiliary frame body 20 are coupled with the respective mullion bodies 12 and 19 with mutually reversed arrangement with respect to the first direction.

The auxiliary frame body 27 coupled with the multi window mullion 1 adjacent to the reentrant corner mullion 5 has the same cross section as that of the auxiliary frame bodies 13 and 20 of the salient corner mullion 4 and the reentrant corner mullion 5. The auxiliary frame body 27 is coupled with the multi window mullion 1 by engaging a pair of engaging pieces 62, 62 in the recess 47 and connecting each other by means of screws. Thus, the multi window mullion 1 and the auxiliary frame body 27 form a T-junction mullion which has glass receptacle grooves 11, 11 opening in the first direction and a glass receptacle groove 29 opening in the second direction and is used for forming a T-shaped portion of the sash.

In the shown embodiment, since the contacting portions of the multi window mullion 1 and the auxiliary frame body 27 are situated in the internal space, it is not necessary to install a sealing member in either of the grooves 63.

Figure 4:
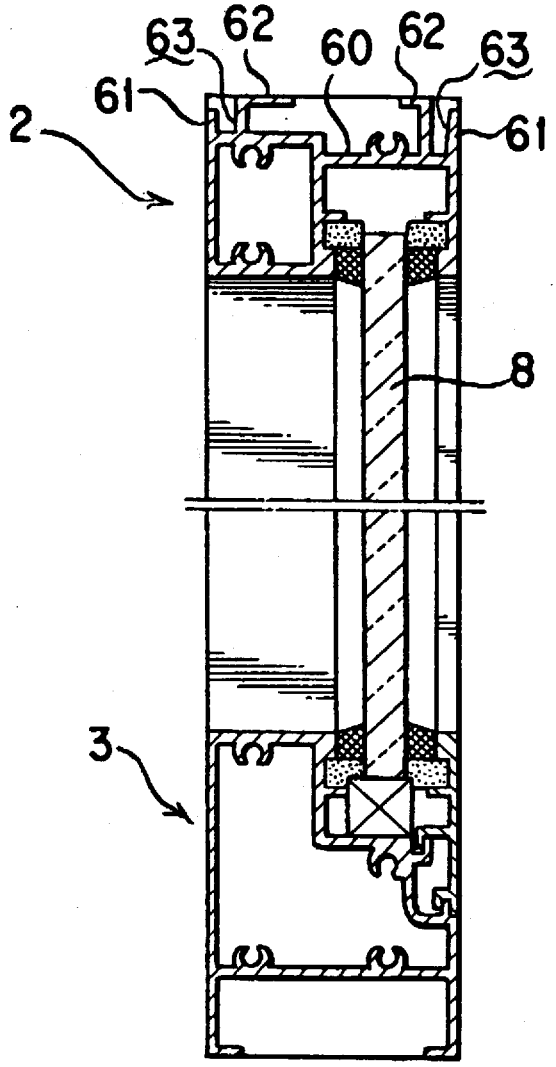
FIG. 4 is a section taken along line G—G of FIG. 3.

As shown in FIG. 4, a dimension, measured in the first direction, of each of the upper horizontal member 2 and the lower horizontal member 3 fixed between the salient corner mullion 4 and the reentrant corner mullion 5 is equal to a dimension, measured in the first direction, of the auxiliary frame body 13 or 20. Further, the upper horizontal member 2 has the same cross section as that of the auxiliary frame body 13 or 20. Therefore, The auxiliary frame body 13 or 20 can be used as the upper horizontal member 2. Detailedly, by fitting anchors to a pair of hook-shaped engaging pieces 62, 62 provided on the mounting surface 60 of the auxiliary frame body 13 or 20 and by welding the anchors onto a reinforcing bar which is fixed to a building body for the purpose of mounting of the upper horizontal member, the auxiliary frame body 13 or 20 can be mounted to the building body for serving as an upper horizontal member 2.

Figure 5:
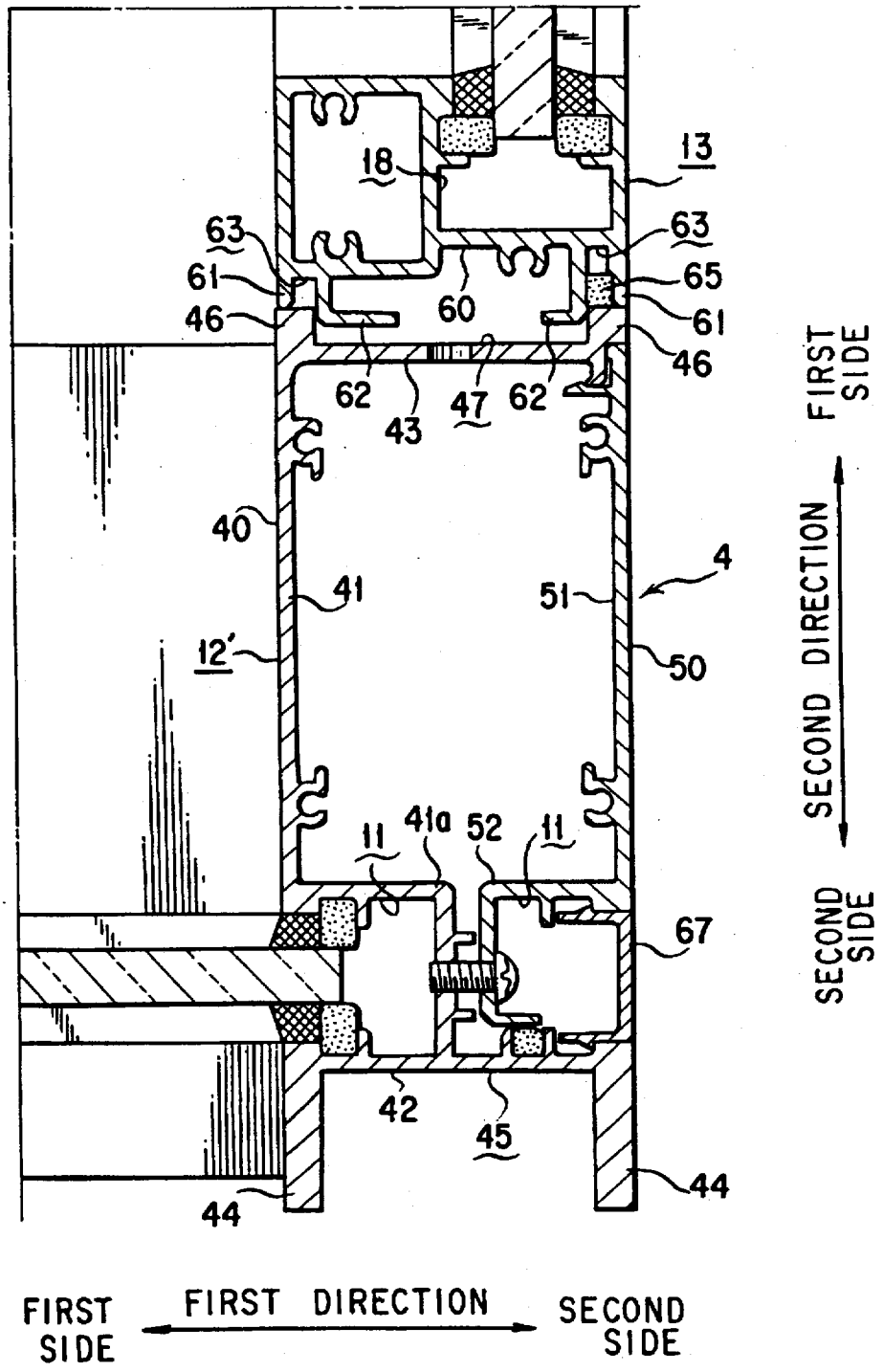
FIG. 5 is a cross section showing another embodiment of a salient corner mullion according to the present invention.

FIG. 5 shows another embodiment of the salient corner mullion 4. An end portion 41*a* of the first vertical plate 41 of the first vertical frame 40 of the mullion body 12' situated at the second side in the second direction is bent in hooked configuration so as to form a glass receptacle groove 11 in cooperation with the second vertical plate 42. Namely, the mullion body 12' has the same cross section as that of the multi window mullion 1, and is provided with glass receptacle grooves 11, 11 at both sides in the first direction. Therefore, the mullion body 12' can be by itself used as a multi window mullion 1. Further, by selectively employing an attachment 67 having C-like cross section, which can be detachably fitted to one of the glass receptacle grooves 11, 11 opening toward mutually opposite sides in first direction, the mullion body 12' can be selectively used for forming the salient corner mullion 4 or the reentrant corner mullion 5, and that without requiring reversing thereof.

Although the invention has been illustrated and described with respect to exemplary embodiment thereof, it should be understood by those skilled in the art that many other changes and modifications may be made without departing from the scopes of the appended claims.

What is claimed is:

1. A partitioning sash having a width and a depth comprising at least one multi window tubular mullion for forming a multiple window portion of said sash, said multi window mullion having glass receptacle grooves on opposite side surfaces situated at both spaced sides in a first direction parallel to the width of said sash;

at lease one salient corner mullion for forming a salient angle portion of said sash, said salient corner mullion having a salient corner mullion tubular body and a salient corner mullion auxiliary frame body, said salient corner mullion tubular body having a first glass receptacle groove on a side surface situated at a first side in said first direction, said salient corner mullion auxiliary frame body having a second glass receptacle groove on a side surface situated at a first side in a second direction parallel to the depth of said sash, said salient corner mullion tubular body and said salient corner mullion auxiliary frame body being coupled with each other such that a side surface of said salient corner mullion auxiliary frame body positioned at a second side in said second direction is fixed to a side surface of said salient corner mullion tubular body positioned at said first side in said second direction, a dimension of said salient corner mullion measured in said first direction being equal to a dimension of said multi window mullion measured in said first direction;

at least one reentrant corner mullion for forming a reentrant angle portion of said sash, said reentrant corner mullion having a reentrant corner mullion tubular body and a reentrant corner mullion auxiliary frame body, said reentrant corner mullion tubular body having a first glass receptacle groove on a side surface situated at a second side opposite to said first side in said first direction said reentrant corner mullion auxiliary frame body having a second glass receptacle groove on a side surface situated at a second side opposite to said first side in said second direction, said reentrant corner mullion tubular body and said reentrant corner mullion auxiliary frame body being coupled with each other such that a side surface of said reentrant corner mullion auxiliary frame body positioned at said first side in said second direction is fixed to a side surface of said reentrant corner mullion tubular body situated at said second side in said second direction, a dimension of said reentrant corner mullion measured in said first direction being equal to said dimension of said multi window mullion measured in said first direction;

upper and lower horizontal members fitted between each two adjacent mullions of said multi window, salient corner and reentrant corner mullions, thereby forming a sash frame having a plurality of quadrangular frame portions; and glasses installed in said quadrangular frame portions.

2. A partitioning sash as set forth in claim 1, wherein said auxiliary frame body of said salient corner mullion and said auxiliary frame body of said reentrant corner mullion have the same configuration in cross section.

3. A partitioning sash as set forth in claim 1, wherein said auxiliary frame body of said salient corner mullion, said auxiliary frame body of said reentrant corner mullion, and an upper horizontal member fitted between said salient corner mullion and said reentrant corner mullion have the same configuration in cross section.

4. A partitioning sash as set forth in claim 1, wherein said mullion body of said salient corner mullion and said mullion body of said reentrant corner mullion have the same configuration in cross section and are set in mutually reversed arrangement with respect to said first direction.

5. A partitioning sash as set forth in claim 1, wherein said second glass receptacle groove of said salient corner mullion and said second glass receptacle groove of said reentrant corner mullion are respectively provided at a position biased to said second side in said first direction.

6. A partitioning sash as set forth in claim 1, wherein said auxiliary frame body of said salient corner mullion and said auxiliary frame body of said reentrant corner mullion have the same configuration in cross section provided with said second glass receptacle groove at a position biased to said second side in said first direction, and are coupled with the respective mullion bodies in mutually reversed arrangement with respect to said first direction.

7. A partitioning sash as set forth in claim 1, wherein said multi window mullion is constituted of a first vertical frame and a second vertical frame connected with each other, said mullion body of said salient corner mullion is constituted of a first vertical frame and a second vertical frame connected with each other, and said mullion body of said reentrant corner mullion is constituted of a first vertical frame and a second vertical frame connected with each other, wherein said first vertical frame of said salient corner mullion and said first vertical frame of said reentrant corner mullion have the same configuration in cross section, and said second vertical frame of said multi window mullion, said second vertical frame of said salient corner mullion and said second vertical frame of said reentrant corner mullion have the same configuration in cross section, and wherein said first vertical frame of said salient corner mullion and said first vertical frame of said reentrant corner mullion are set in mutually reversed arrangement with respect to said first direction, and said second vertical frame of said salient corner mullion and said second vertical frame of said reentrant corner mullion are set in mutually reversed arrangement with respect to said first direction so that said first glass receptacle groove of said salient corner mullion and said first glass receptacle groove of said reentrant corner mullion open toward opposite sides in said first direction.

8. A partitioning sash as set forth in claim 1, wherein said sash further comprises a T-junction mullion for forming a T-shaped portion of said sash, wherein said T-junction mullion comprises a mullion body having first and second glass receptacle grooves on side surfaces situated at both sides in said first direction and an auxiliary mullion body having a third glass receptacle groove on a side surface situated at said first side in said second direction, said mullion body and said auxiliary frame body being coupled with each other in such manner that a side surface of said auxiliary frame body situated at said second side in said second direction is fixed to a side surface of said mullion body situated at said first side in said second direction, wherein said multi window mullion and said mullion body of said T-junction mullion have the same configuration in cross section, wherein said mullion body of said salient corner mullion and said mullion body of said reentrant corner mullion have the same configuration in cross section and are set in mutually reversed arrangement with respect to said first direction, and wherein said auxiliary frame body of said salient corner mullion, said auxiliary frame body of said reentrant corner mullion, and said auxiliary frame body of said T-junction mullion have the same configuration in cross section.

9. A mullion for forming a sash, comprising:

a tubular mullion body having a first glass receptacle groove on a side surface to be located at one side in a first direction parallel to a width of said sash, and having first and second recesses on opposite side surfaces to be located at both spaced sides in a second direction parallel to a depth of said sash, said first and second recesses having the same opening width; and an auxiliary frame body having a mounting surface to be located at one side in said second direction, and having a second glass receptacle groove formed on a side surface spaced and opposite to said mounting surface so as to open in said second direction, said mounting surface having a pair of engaging pieces projecting in said second direction for being engaged in one of said first and second recesses.

10. A mullion as set forth in claim 9, wherein said mullion body is constituted of a first vertical frame selectively to be located at either one side in said first direction and a second vertical frame to be located at an opposite side to said first vertical frame, and said first vertical frame and said second vertical frame are connected with each other so as to form said first glass receptacle groove selectively at either one side in said first direction.

11. A mullion as set forth in claim 9, wherein said second glass receptacle groove is provided at a position biased to either one side in said first direction.

12. A mullion as set forth in claim 9 wherein said mounting surface is further provided with a pair of supporting pieces projecting in said second direction, and each one groove is defined between each one supporting piece and each one engaging piece in which a sealing member can be selectively installed.

13. A mullion for forming a sash, comprising:

a tubular mullion body having first and second glass receptacle grooves on side surfaces to be located at both sides in a first direction parallel to a width of said sash, and having first and second recesses on opposite side surfaces to be located at both spaced sides in a second direction parallel to a depth of said sash, said first and second recesses having the same opening width;

an auxiliary frame body having a mounting surface to be located at one side in said second direction, and having a third glass receptacle groove formed on a side surface spaced and opposite to said mounting surface so as to open in said second direction, said mounting surface having a pair of engaging pieces projecting in said second direction for being engaged in one of said first and second recesses; and an attachment capable of being detachably fitted to one of said first and second glass receptacle grooves.

14. A mullion as set forth in claim 13, wherein said mullion body is constituted of a first vertical frame and a second vertical frame connected with each other.

15. A mullion as set forth in claim 13, wherein said third glass receptacle groove is provided at a position biased to one side in said first direction.

16. A mullion as set forth in claim 13, wherein said mounting surface is further provided with a pair of supporting pieces projecting in said second direction, and each one groove is defined between each one supporting piece and each one engaging piece in which a sealing member can be selectively installed.

* * * * *

UNITED STATES PATENT AND TRADEMARK OFFICE

CERTIFICATE OF CORRECTION

PATENT NO. : 5,682,714

DATED : November 04, 1997

INVENTOR(S) : Yoshinori ISHIKURO et al.

It is certified that error appears in the above-indentified patent and that said Letters Patent is hereby corrected as shown below:

* On the Title Page, Item [57], in the Abstract, line 12, "end" should read --and--.

Claim 1, column 9, line 65, "lease" should read --least--.

Signed and Sealed this

Nineteenth Day of May, 1998

Bruce Lehman

*Attest:*

BRUCE LEHMAN

*Attesting Officer*

*Commissioner of Patents and Trademarks*